US005640725A

United States Patent [19]

Ando et al.

[11] Patent Number: 5,640,725

[45] Date of Patent: Jun. 24, 1997

[54] SLEEPING BAG

[75] Inventors: Shozo Ando, Tokyo; Hisato Kawahira, 1-13-102, Ibukino, Midori-ku, Yokohama, Kanagawa, both of Japan

[73] Assignee: Hisato Kawahira, Yokohama, Japan

[21] Appl. No.: 568,602

[22] Filed: Dec. 5, 1995

[30] Foreign Application Priority Data

Dec. 6, 1994 [JP] Japan ..... 6-329836

[51] Int. Cl.[6] ..... A47G 9/08; A47C 27/10

[52] U.S. Cl. ..... 5/413 AM; 5/710

[58] Field of Search ..... 5/413, 419, 706, 5/710; 2/69.5

[56] References Cited

U.S. PATENT DOCUMENTS

| | | | |
|---|---|---|---|
| 1,324,009 | 2/1919 | Hope | 5/413 |
| 1,648,373 | 1/1927 | Vilas | 5/413 |
| 4,862,533 | 9/1989 | Adams, III | 5/413 |

FOREIGN PATENT DOCUMENTS

| | | | |
|---|---|---|---|
| 2305154 | 10/1976 | France | 5/413 |
| 7511788 | 11/1976 | France | 5/413 AM |
| 2516781 | 10/1976 | Germany | 5/413 |
| 70527 | 9/1942 | Sweden | 5/413 |
| 702513 | 1/1954 | United Kingdom | 5/413 |
| 979852 | 1/1965 | United Kingdom | 5/413 |

*Primary Examiner*—Alexander Grosz
*Attorney, Agent, or Firm*—Browdy and Neimark

[57] ABSTRACT

A sleeping bag is provided which is free from the problems of the bag body slipping off an air mattress laid therebeneath, the air pillow slipping off the bag body, etc. so that there is no fear of comfortable sleep being disturbed. The bag body 1 is composed of a mattress portion 1*a* and a coverlet portion 1*b*. The mattress portion 1*a* and the coverlet potion 1*b* are joined to each other so that the coverlet potion 1*b* is folded over the mattress 1*a*. The insides of the mattress portion 1*a* and the coverlet portion 1*b* are stuffed with cotton or feather paddings having the adiabatic property. The other sides of the respective mattress portion and the coverlet portion as well as the foot ends thereof are provided with slide fasteners 1*c* continuously therealong so that a generally envelope shaped structure is formed. The air mattress 2 is inserted through the air mattress inlet 1*d* formed along the foot end of the mattress portion 12*a* into the inside of the mattress portion 1*a* as shown by arrow mark 2'The head end side of the mattress portion 1*a* is opened with air pillow inlet 1f which allows insertion of the air pillows 3 into the head portion of the mattress portion 1*a*.

9 Claims, 3 Drawing Sheets

SLEEPING BAG

BACKGROUND OF THE INVENTION

The present invention relates to a sleeping bag and more particularly to a sleeping bag which is used within or outside a camping tent for outdoor activities.

The conventionally used sleeping bag for camping purposes is composed of a mattress portion and a coverlet portion, said mattress portion and said coverlet portion being joined to each other at one side thereof while the inside of the sleeping bag is stuffed with cotton paddings or the like. Along the other sides and foot ends of said mattress portion and those of said coverlet portion are attached slide fasteners for closing said sleeping bag with the coverlet portion being laid over the mattress portion like an envelope.

Said conventional sleeping bag has a problem is that the camper fails to get sound sleep when used on undulations of the camping ground. Therefore, the camper is forced to extend an air mattress or other cushioning materials beneath the sleeping bag or place an air pillow at a head portion thereof.

However, even if an air mattress or the like is used in the manner mentioned above, the conventional sleeping bag has the following problems:

1) the sleeping bag fails to give the camper a sound sleep on account of its general tendency to slip off the air mattress or the air pillow's slipping off the sleeping bag;
2) the camper must use such a large sized air mattress so as to prevent the sleeping bag from slipping off it that a space economy is neglected; and
3) if a sheet material is selected to be used beneath the sleeping bag, comfortable sleep is not enjoyed where there are undulations at a camping site because such sheet material lacks cushioning functions and it is impossible to block the cold from beneath particularly on the snow-clad ground so that many insulating layers must be used to make up for such drawback.

SUMMARY OF THE INVENTION

The present invention is made to solve the aforementioned problems and its object is to provide a sleeping bag which is free from the problem that comfortable sleep is disturbed by the sleeping bag slipping off the air mattress therebeneath or the air pillow thereon slipping off the sleeping bag.

In order to solve the aforementioned problems, the present invention provides a sleeping bag comprising a bag body having a mattress portion and a coverlet portion, said mattress portion being joined to said coverlet portion at respective first sides thereof, said respective mattress portion and coverlet portion being stuffed with cotton paddings therein, said bag body further having slide fastener means provided along respective second sides thereof and respective foot portion ends thereof; an air mattress adapted to be accommodated within said mattress portion of the bag body in such a manner as to be drawn out therefrom; and an air pillow adapted to be accommodated within said mattress portion at head portion thereof in such a manner as to be drawn out therefrom.

DETAILED DESCRIPTION OF THE EMBODIMENT

The embodiments of the present invention will be explained referring to the accompanying drawings.

Figure 1:
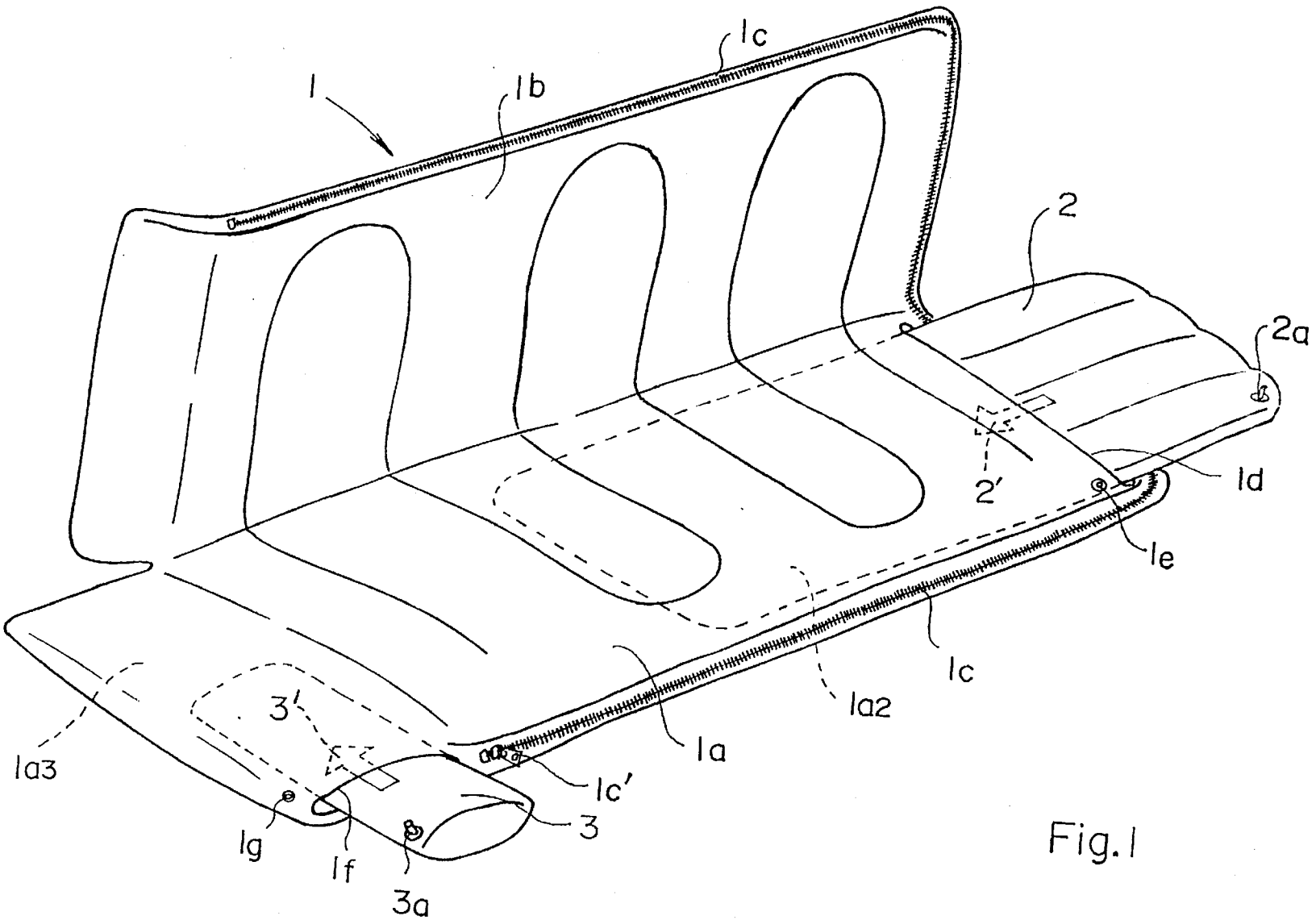
FIG. 1 is a perspective view of a sleeping bag according to the present invention.

FIG. 1 shows that bag body 1 is composed principally of mattress portion 1*a* and coverlet portion 1*b*. Said mattress portion 1*a* and said coverlet portion 1*b* are joined to each other along one side thereof with coverlet portion 1*b* being folded over mattress portion 1*a* for use.

Figure 2:
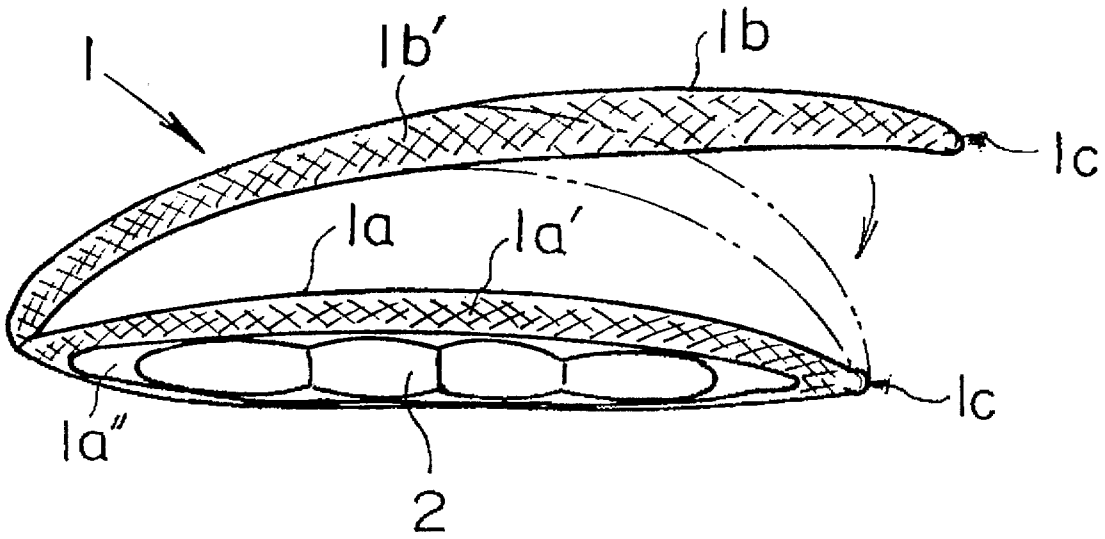
FIG. 2 is a lateral cross section of the sleeping bag of FIG. 1.

As apparent from FIG. 2, the inside of said mattress portion 1*a* and said coverlet portion 1*b* are stuffed with paddings 1*a'* and 1*b'* such as cotton materials or feathers having adiabatic properties.

Slide fastener 1*c* is attached thereto along the other side and the foot portion end of said mattress portion 1*a* and said coverlet portion 1*b* so that the entire structure is shaped like an envelope.

Figure 3:
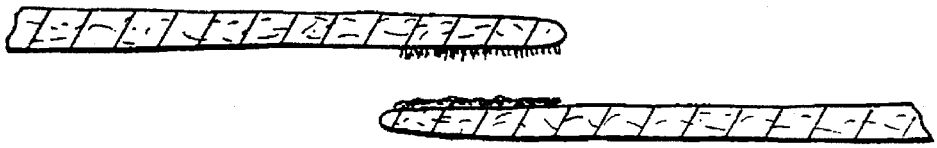
FIG. 3 is a lateral cross section of a flat fastener.

Air mattress 2 is provided to be inserted into the inside of said mattress portion la as shown by arrow mark 2' through air mattress inlet 1*d* formed along the foot end of said mattress portion 1*a*. As apparent from FIG. 2, said air mattress 2 is accommodated within air mattress space 1*a*2 defined beneath said paddings 1*a'*. Otherwise, said air mattress inlet 1*d* may be formed in the bottom side of said mattress portion 1*a*. Said opening 1*d* is adapted to be closed by a slide fastener or a flat fastener shown in FIG. 3. Air inlet tip 2*a* is inserted into hole 1*e* formed in mattress portion 1*a* to protrude out said hole 1*e* with air mattress 2 being inserted in the inside of said mattress portion 1*a'*.

On the other hand, one side of the forward end of said mattress portion 1*a* is formed with air pillow inlet if which allows insertion of air pillow 3 therethrough into the head portion of said mattress portion 1*a* as shown by arrow mark 3'. Said air pillow inlet 1*f* is adapted to be closed by suitable means such as a fastener not shown. Here again, air inlet tip 3*a* is inserted through hole 1*g* to protrude thereout. In this way, the inside of mattress portion 1*a* is partitioned into air mattress space 1*a*2 and air pillow space 1*a*3.

With the sleeping bag of this embodiment constructed as shown in the foregoing, the camper can start the use thereof by blowing up said air mattress 2 by admitting air by suitable air pumping means (not shown) through air inlet 2*a*. Next, said air mattress 2 is inserted into air mattress space 1*a*2 of said mattress portion 1*a* of bag body 1 through air mattress inlet 1*d* formed at the foot portion thereof as shown by arrow mark 2'.

Then, air is blown into pillow 3 through air inlet 3*a* by means of a suitable air pump not shown and said blown up air pillow 3 is inserted through air pillow inlet 1*f* formed in the side of head portion of said mattress portion 1*a* into air pillow space 1*a*3 of the head portion of mattress portion 1*a* as shown by arrow 3' in FIG. 1.

When the aforementioned procedure is completed, said coverlet portion 1*b* is folded over said mattress portion 1*b* to close slide fastener 1*c* by pulling slide 1*c'* so that a generally envelope shaped sleeping bag with an opening at the head portion is formed.

After the use of said sleeping bag, air is discharged from air mattress 2 and air pillow 3 through air inlets 2*a* and 3*a* protruding out the respective holes 1*e* and 1*g*. Then, said bag body 1 is folded up in a suitable manner and accommodated in an accommodation bag not shown. Said air space 1a2, air pillow space 1a3, and/or air pillow 3 may be drawn out of mattress portion 1a and pillow portion 1b in an inflated or deflated condition before said bag body 1 is folded up.

Said slide fastener 1c is operated by a single slider 1c' in the aforementioned embodiment but two sliders may be used for this purpose. Also, two bag bodies 1 may be prepared to be joined to each other at joining sides of the respective mattress portions 1a and coverlet portions 1b to form a so-called twin sleeping bag.

As explained in the foregoing, the bag body, the air mattress and the air pillow are unitized, eliminating the chance of the bag body slipping off an air mattress or the air pillow slipping off the bag body during the camper's sleep with the result that discomfort from undulations formed by gravels, stones, etc. or the coldness is avoided and even a man having a habit of badly tossing about or a person of nervous character can enjoy a comfortable sleep.

Further, the air pillow can be used independently of the air mattress since the air mattress and the air pillow are independently inserted into the sleeping bag.

Still further, even if the air mattress and the air pillow should be damaged, repair for reuse or replacement thereof has been made possible.

What is claimed is:

1. In a sleeping bag (1) of the type having an outer cover, a mattress portion (1a), and a coverlet portion (1b), the mattress portion and the coverlet portion being stuffed with fibrous insulation (1a', 1b'), the mattress portion and the coverlet portion being joined along respective first sides thereof, slide fastener means (1c) for joining the mattress portion and the coverlet portion along respective second sides thereof to close the bag;

wherein the mattress portion comprises:

an air mattress first space (1a2) disposed in a body area of the mattress portion between the outer cover and the fibrous insulation, the first space including a first closable opening (1d); and an air mattress second space (1a3) disposed in a head area of the mattress portion between the outer cover and the fibrous insulation, the second space including a second closable opening (1f); and a body air mattress (2) removably held in the first space by the first closable opening and an air mattress pillow (3) removably held in the second space by the second closable opening;

wherein the mattress portion comprises:

a single first air inlet hole (1e) adjacent a foot end of the bag and a single second air inlet hole (1g) adjacent a head end of the bag;

a single first air inlet (2a) of the body air mattress protruding through the first air inlet hole; and a single second air inlet (3a) of the air mattress pillow protruding through the second air inlet hole;

and wherein the first closable opening runs transversely to a length of the bag and is located at foot end of the bag, and the second closable opening runs longitudinally to the length of the bag and is located at a head end of the bag.

2. The improvement according to claim 1, wherein the first closable opening includes a zipper.

3. The improvement according to claim 1, wherein the second closable opening includes a zipper.

4. The improvement according to claim 1, wherein the first closable opening includes a flat fastener.

5. The improvement according to claim 1, wherein the second closable opening includes a flat fastener.

6. The improvement according to claim 1, wherein the inside of the mattress portion is partitioned into said first and said second spaces.

7. The improvement according to claim 1, wherein the fibrous insulation comprises cotton.

8. The improvement according to claim 1, wherein the fibrous insulation comprises feathers.

9. The improvement according to claim 1, wherein the first air inlet and the second air inlet include protruding tubular members.

* * * * *